US007523699B2

(12) United States Patent
Sakamoto

(10) Patent No.: US 7,523,699 B2
(45) Date of Patent: Apr. 28, 2009

(54) LINEAR MOTOR MOUNTED PRESS MACHINE AND METHOD FOR CONTROLLING LINEAR MOTOR MOUNTED PRESS MACHINE

(75) Inventor: Hiroichi Sakamoto, Inuyama (JP)

(73) Assignee: Murata Kikai Kabushiki Kaisha, Kyoto-shi (JP)

( * ) Notice: Subject to any disclaimer, the term of this patent is extended or adjusted under 35 U.S.C. 154(b) by 0 days.

(21) Appl. No.: 11/842,265

(22) Filed: Aug. 21, 2007

(65) Prior Publication Data

US 2008/0041241 A1 Feb. 21, 2008

(30) Foreign Application Priority Data

Aug. 21, 2006 (JP) ..... 2006-223780

(51) Int. Cl.
*B30B 1/10* (2006.01)

(52) U.S. Cl. ..... 100/43; 100/35; 100/281; 72/451; 83/630; 310/12

(58) Field of Classification Search ..... 100/35, 100/43, 50, 272, 281, 283, 284, 286; 72/451; 83/543, 630, 632, 613; 310/12
See application file for complete search history.

(56) References Cited

U.S. PATENT DOCUMENTS 5,845,528 A * 12/1998 Wollermann ..... 72/451
5,916,345 A * 6/1999 Kobayashi ..... 83/543
6,012,321 A * 1/2000 Ito et al. ..... 72/443

FOREIGN PATENT DOCUMENTS

JP 8103897 A 4/1996
JP 2001150193 A 6/2001
JP 2001352747 A 12/2001
JP 2004202505 A 7/2004

* cited by examiner

*Primary Examiner*—Jimmy T Nguyen
(74) *Attorney, Agent, or Firm*—Westerman, Hattori, Daniels & Adrian, LLP.

(57) ABSTRACT

The present invention provides a linear motor mounted press machine which uses a boosting mechanism to enable machining with a greater press tonnage using a press driving source with relatively low power and which, for machining with a smaller press tonnage, enables efficient high-speed machining. A linear motor mounted press machine includes a boosting mechanism 10 having an output portion that performs a rectilinear reciprocating operation, a first linear motor 11 coupled to an output portion of the boosting mechanism 10, a second linear motor 12 having an output shaft that drives a press tool 6 forward and backward, and a coupling switching mechanism 13. The coupling switching mechanism 13 releasably couples the output shaft of the second linear motor 12 to the output portion of the boosting mechanism 10. The boosting mechanism 10 is a toggle-type link mechanism or the like. A servo motor and a crank mechanism or the like may be used in place of the first linear motor 11.

7 Claims, 7 Drawing Sheets

LINEAR MOTOR MOUNTED PRESS MACHINE AND METHOD FOR CONTROLLING LINEAR MOTOR MOUNTED PRESS MACHINE

FIELD OF THE INVENTION

The present invention relates to a linear motor mounted press machine using linear motors, and a method for controlling the linear motor mounted press machine.

BACKGROUND OF THE INVENTION

Press machines such as punch presses commonly use, as a press driving source that moves punches forward and backward, a mechanism that rotates a flywheel by means of a rotary electric motor to obtain press driving force using the inertia force of the flywheel, or a hydraulic cylinder. Mechanisms using a flywheel cannot vary a ram speed during strokes. Accordingly, proposals have been made of press machines that use a servo motor instead of the flywheel to vary a punch speed during strokes in order to reduce noise and to improve processing quality.

Where a servo motor is used as a press driving source, it may be difficult to directly obtain a force required for punching. Thus, press machines using a boosting mechanism such as a toggle mechanism have been proposed (for example, the Unexamined Japanese Patent Application Publication (Tokkai-Hei) 8-103897). Attempts have also been made to use a linear motor as a press driving source. Unlike the use of a rotary motor, the use of a linear motor for punch driving eliminates the need for a mechanism that converts rotation into rectilinear motion. This makes it possible to provide a simple structure with a reduced number of parts required.

Press working based on a punch press or the like generally requires the use of the same machine for different machining operations including one needing a greater press tonnage and one needing only a smaller press tonnage. The machining operation needing only a smaller press tonnage generally requires a high speed. Using the same whole press machine for all the operations is contradictory to increased speed and efficiency and saved energy.

Thus, proposals have been made of provision of a second press driving source used for high-speed machining. However, where a boosting mechanism is used, the second press driving source is coupled to an input side of the boosting mechanism, whenever the second press driving source is used, it must be operated via the boosting mechanism. This reduces the efficiency of power transmission. Further, an output side of the boosting mechanism, composed of a toggle mechanism or the like, performs rectilinear reciprocating operations. Consequently, it is difficult to couple the output of the second press driving source, composed of a servo motor or the like, to the output side of the boosting mechanism.

SUMMARY OF THE INVENTION

It is an object of the present invention to provide a linear motor mounted press machine which uses a boosting mechanism to enable machining with a greater press tonnage using a press driving source with relatively low power and which, for machining with a smaller press tonnage, enables efficient high-speed machining.

It is another object of the present invention is to simplify the configuration of the whole press driving system.

It is yet another object of the present invention is to make it possible to switchably couple and decouple an output shaft of a linear motor to and from the output portion of the boosting mechanism using a simple configuration.

It is still another object of the present invention to use a plurality of unit linear motors to increase power and to use these unit linear motors to provide balanced rectilinear-propagation outputs.

It is further another object is to allow each unit linear motor to be made compact and efficient and to allow the unit linear motors to be combined into a simple configuration.

It is a further object of the present invention to appropriately controllably drive both linear motors for machining requiring a greater press tonnage and for machining requiring a smaller press tonnage to achieve efficient operations.

A linear motor mounted press machine according to the present invention comprises a boosting mechanism having an output portion that performs a rectilinear reciprocating operation, a first press driving source having an output shaft coupled to an input portion of the boosting mechanism, a linear motor having an output shaft serving as a second press driving source that drives a press tool forward and backward, and a coupling switching mechanism that releasably couples the output shaft of the linear motor and the output portion of the boosting mechanism together.

This configuration brings the coupling switching mechanism into a coupling state to allow the first press driving source to be driven so that the driving force of the first press driving source is transmitted to the press tool via the boosting mechanism. The use of the boosting mechanism enables pressing with a greater press tonnage. In this case, the linear motor serving as the second press driving source may be in a driving state or a non driving state. Bringing the second press driving source into the driving state provides a high thrust corresponding to a combination of the driving forces of the first and second press driving sources. Since the second press driving source is a linear motor, it can be coupled, by simple arrangements, to the output portion of the boosting mechanism, which performs a rectilinear reciprocating operation. By bringing the coupling switching mechanism into a decoupling state to allow the linear motor serving as the second press driving source to be driven, pressing can be performed by driving only this linear motor. Consequently, when this linear motor provides appropriate motor outputs, high-speed press working can be efficiently achieved. In this case, the linear motor serving as the second press driving source is disconnected from the boosting mechanism by the coupling switching mechanism. This prevents the boosting mechanism and the first press driving source from offering resistance, allowing the press tool to operate efficiently.

The boosting mechanism may be a link mechanism. Various boosting mechanisms based on the link mechanism have an output portion that performs rectilinear reciprocating operations. For example, a toggle mechanism may be adopted.

In the present invention, the first press driving source may be a linear motor. The use of the linear motor allows motor outputs to be transmitted to the boosting mechanism having the output portion that performs rectilinear reciprocating operations, without using any rotation/rectilinear operation converting mechanism. This makes it possible to simplify the configuration of the whole press driving system.

The coupling switching mechanism may comprise a coupling member that is removably inserted into a hole formed in the output shaft of the linear motor and into a hole formed in the output portion of the boosting mechanism. When the coupling member is inserted and removed as described above, the coupling and decoupling states of the output shaft of the linear motor and the output portion of the boosting mechanism can be switched between using simple arrangements.

In the present invention, the linear motor serving as the second press driving source may be a unit linear motor assembly having a plurality of unit linear motors arranged around the output portion of the boosting mechanism which performs a rectilinear reciprocating operation. Where the linear motor is the unit linear motor assembly, the power of the individual unit linear motors can be collectively used to obtain high power. The plurality of unit linear motors are arranged around the output portion of the boosting mechanism which performs a rectilinear reciprocating operation. Consequently, in spite of the installation of the plurality of unit linear motors, balanced rectilinear-propagation outputs and a compact configuration can be obtained.

The linear motor serving as the first press driving source may also comprise a plurality of unit linear motors arranged in parallel. Linear motors generally use permanent magnets with a strong magnetic force. However, for obtaining a high thrust by a linear motor, it is difficult to manufacture linear motors owing to the manufacturing limit on the size of magnets, limitations on supply voltage, or the like. Assembling a plurality of unit linear motors together easily provides a high-power linear motor.

Where the linear motor is an assembly of unit linear motors, the unit linear motor may be a cylindrical linear motor having a shaft member comprising a permanent magnet having N poles and S poles alternately arranged in an axial direction and a coil unit through which the shaft member is movable relative to the coil unit. In the cylindrical linear motor, the coil unit is positioned around the periphery of a magnet member, allowing magnetic fields to be efficiently utilized. This results in a compact, efficient linear motor.

In the present invention, the press machine may further comprise coupling state and motor-to-be-used selection control means for performing control such that when a required press tonnage is smaller than a set press tonnage, the coupling switching mechanism is brought into a decoupling state to allow only the linear motor serving as the second press driving source to be driven, and when the required press tonnage is at least the set press tonnage, the coupling switching mechanism is brought into a coupling state so that the first press driving source cooperates with the second press driving source in performing a driving operation. Where the coupling state and motor-to-be used selection control means is provided to control the coupling and driving of both linear motors in accordance with the required press tonnage, both linear motors can be appropriately selectively driven to efficiently perform a machining operation requiring a greater press tonnage and a machining operation requiring a high speed and a smaller press tonnage.

The linear motor mounted press machine according to the present invention comprises the boosting mechanism having the output portion that performs a rectilinear reciprocating operation, the first press driving source having the output shaft coupled to the input portion of the boosting mechanism, the linear motor having the output shaft serving as the second press driving source that drives the press tool forward and backward, and the coupling switching mechanism that releasably couples the output shaft of the linear motor and the output portion of the boosting mechanism together. Consequently, the boosting mechanism can be used to achieve machining with a greater press tonnage using a press driving source with relatively low power. For machining with a smaller press tonnage, high-speed machining can be efficiently achieved. When the boosting mechanism is a link mechanism, its configuration can be simplified. Where the first press driving source is a linear motor, the configuration of the whole press driving system can be simplified. Where the coupling switching mechanism comprises the coupling member that is removably inserted into the hole formed in the output shaft of the linear motor and into the hole formed in the output portion of the boosting mechanism, the coupling and decoupling states of the output shaft of the linear motor and the output portion of the boosting mechanism can be switched using simple arrangements. Where the linear motor serving as the second press driving source is the unit linear motor assembly having the plurality of unit linear motors arranged around the output portion of the boosting mechanism which performs a rectilinear reciprocating operation, the plurality of unit linear motors can be used to increase power and to provide balanced rectilinear-propagation outputs. The unit linear motors can also be compactly arranged. Where the unit linear motor is the cylindrical linear motor having the shaft member comprising the permanent magnet having the N poles and S poles alternately arranged in the axial direction and the coil unit through which the shaft member is movable relative to the coil unit, each of the unit linear motors may be made compact and efficient. The unit linear motors can also be combined into a simple configuration.

When the press machine further comprises the coupling state and motor-to-be-used selection control means for performing control such that where the required press tonnage is smaller than the set press tonnage, the coupling switching mechanism is brought into the decoupling state and only the linear motor serving as the second press driving source is driven, and where the required press tonnage is at least the set press tonnage, the coupling switching mechanism is brought into the coupling state so that the first press driving source cooperates with the second press driving source in performing a driving operation, both linear motors can be appropriately driven to efficiently perform a machining operation requiring a greater press tonnage and a machining operation requiring a high speed and a smaller press tonnage.

Other features, elements, processes, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
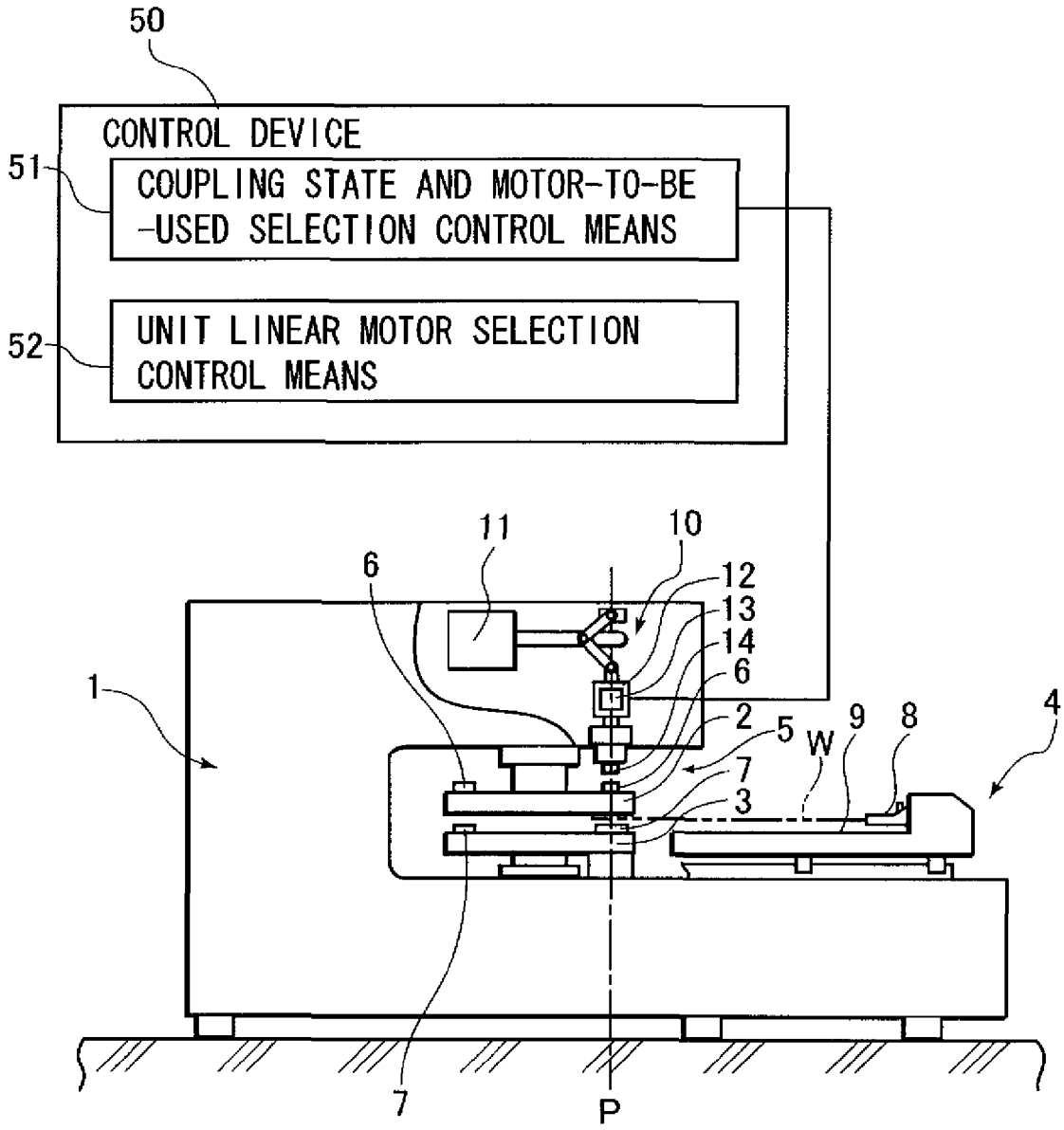
FIG. 1 is an explanatory drawing showing to a combination of a side view of a linear motor mounted press machine in accordance with a first embodiment of the present invention and a block diagram of a control system for the linear motor mounted press machine.

A first embodiment of the present invention will be described with reference to FIGS. 1 to 6. The linear motor mounted press machine comprises a punch press having a press frame 1, and a vertical pair of tool supports 2, 3, a workpiece feeding mechanism 4, and a press driving mechanism 5 which are installed on the press frame 1.

The tool supports 2, 3 comprise an upper turret and a lower turret, respectively, which are concentrically installed and have punch press tools 6 and die press tools 7, respectively, mounted at a plurality of positions in a circumferential direction. Rotation of the tool supports 2, 3 indexes each of the press tools 6, 7 to a predetermined press working axis center P.

The workpiece feeding mechanism 4 has a workpiece holder 8 that grips an edge of a workpiece W that is a plate material to move the workpiece W forward, backward, rightward, and leftward on a table 9.

The press driving mechanism 5 comprises a first linear motor 11 that is a first press driving source, a boosting mechanism 10 having an output portion that performs rectilinear reciprocating operations, and a second linear motor 12 that is a second press driving source. The first linear motor 11 has a horizontally installed output shaft, and the second linear motor 12 has a vertically installed output shaft. The output shaft of the first linear motor 11 is coupled to an input portion of the boosting mechanism 10, and an output portion of the boosting mechanism 10 and the output shaft of the second linear motor 12 are releasably coupled together by a coupling switching mechanism 13. A ram 14 is coupled to the output shaft of the second linear motor 12 to allow the punch press tool 6 of a punch side to be lowered for a press working. The press tool 6 may be elevated and returned by a spring member (not shown in the drawings) or may be forcibly lifted by the ram 14.

Figure 2:
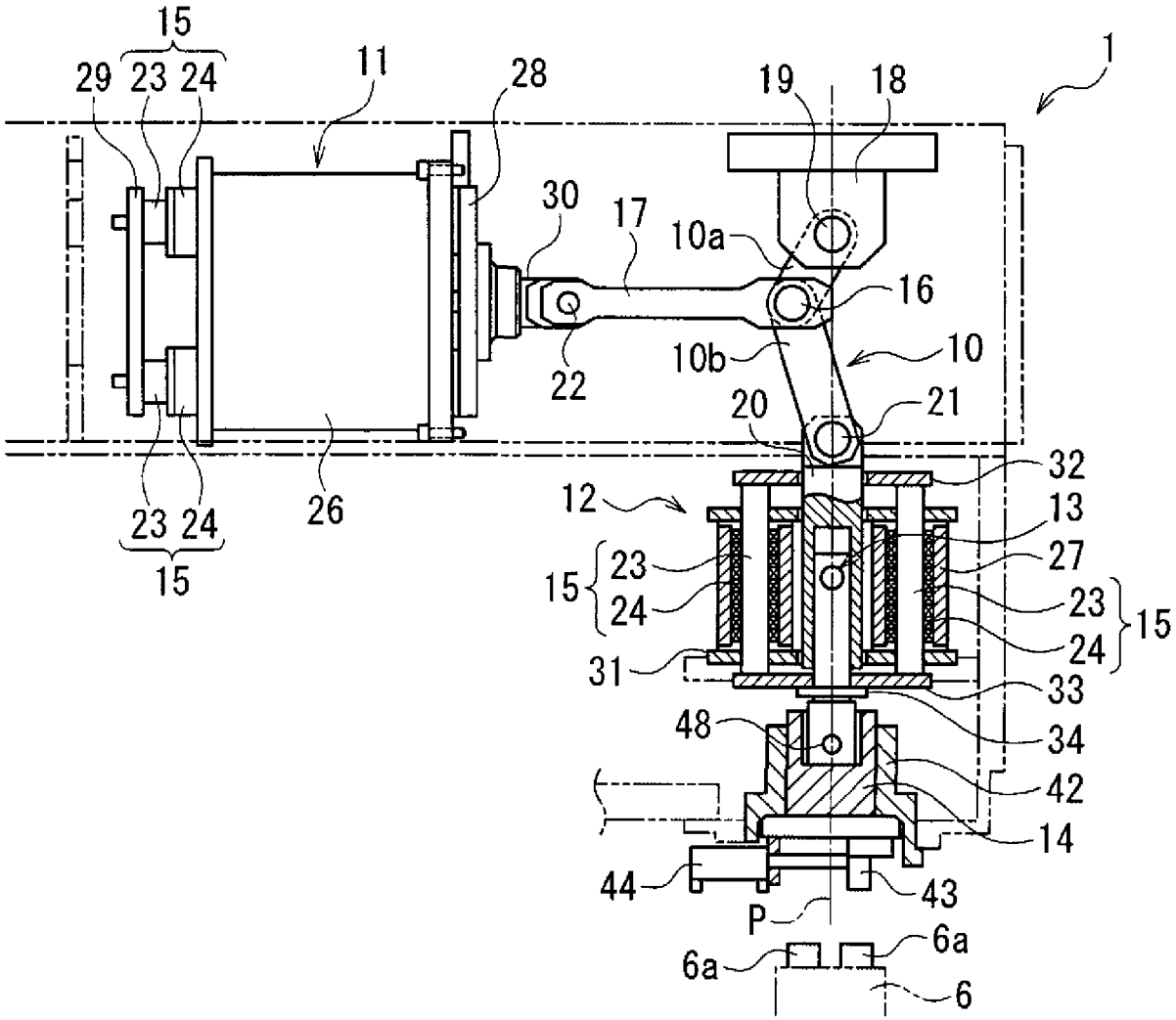
FIG. 2 is a plan view showing the relationship between a first linear motor, a boosting mechanism and a second linear motor which are provided in the linear motor mounted press machine.
Figure 3:
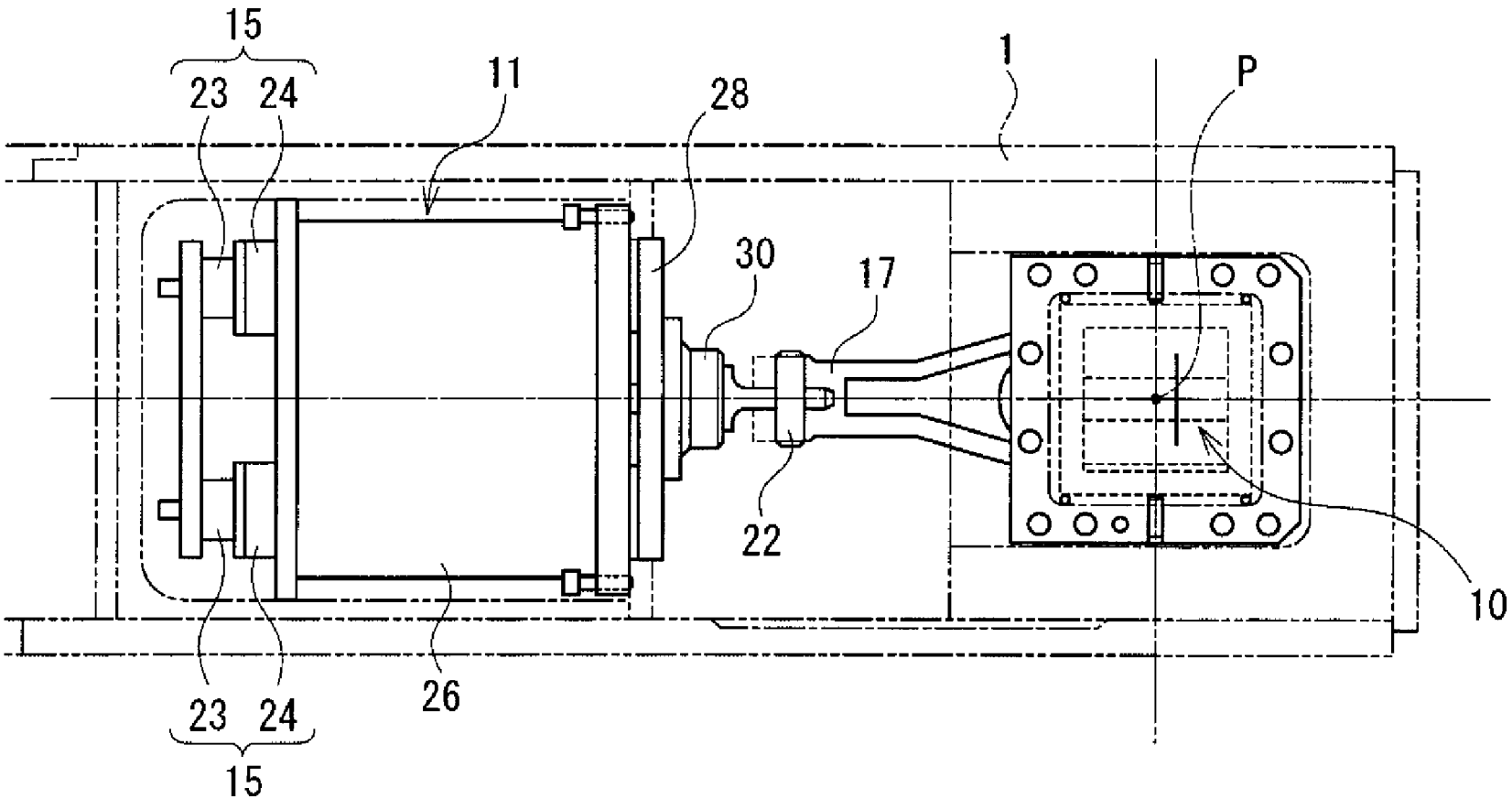
FIG. 3 is a plan view showing the relationship between the first linear motor and boosting mechanism of the linear motor mounted press machine.

As shown in FIG. 2 and FIG. 3, the boosting mechanism 10 comprises a toggle-type link mechanism and has a shorter upper side link 10 and a longer lower side link 10*b* bendably coupled together by a pin 16. The boosting mechanism 10 is drivingly bent by moving forward and backward an input lever 17 coupled to the pin 16 to serve as an input portion. The upper side link 10*a* is pivotably coupled by a pin 19 to a mount 18 provided on the press frame 1. The lower side link 10*b* is pivotably coupled by a pin 21 to an output portion shaft 20 which can be elevated and lowered and which has a lower end serving as an output portion.

As shown in FIG. 2, the second linear motor 12 is a unit linear motor assembly having a plurality of unit linear motors 15 arranged on a circumference around the predetermined center P. In the illustrated example, two unit linear motors 15 constitute one linear motor 12. However, the number of unit linear motors 15 may be three or more. The predetermined center P is the center of the output portion shaft 20 of the boosting mechanism 10 and also serves as a press working axis center.

Figure 5:
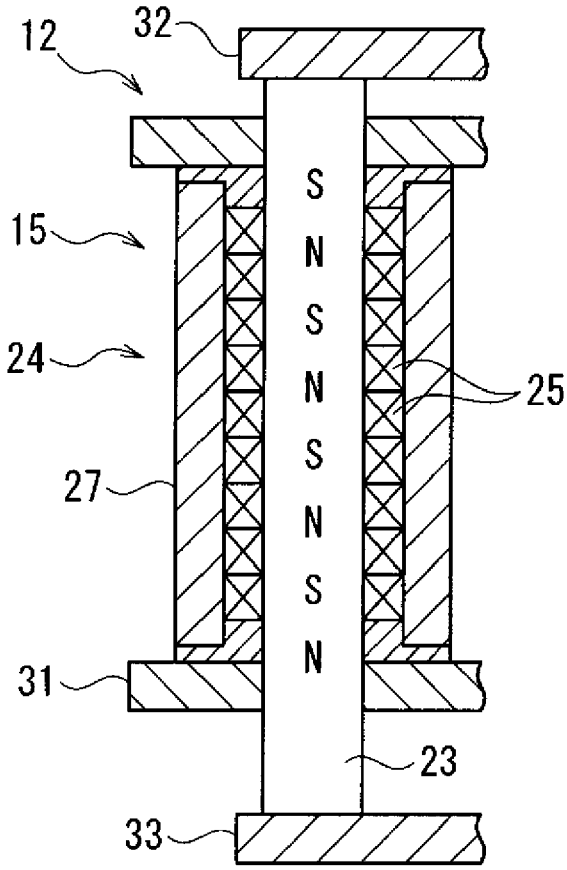
FIG. 5 is an enlarged sectional view showing a unit linear motor of the second linear motor.
Figure 6:
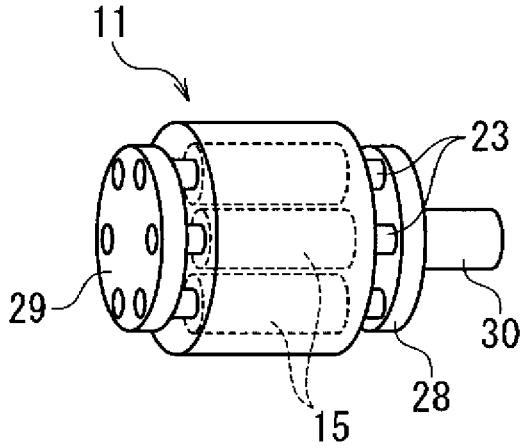
FIG. 6 is a schematic perspective view of the first linear motor.

As shown in FIG. 5, each of the unit linear motors 15 is a cylindrical linear motor comprising a shaft member 23 composed of a permanent magnet having alternatively arranged N and S poles, and a coil unit 24 through which the shaft member 23 is movable in an axial direction relative to the coil unit 24. The coil unit 24 comprises a plurality of coils 25 surrounding the periphery of the shaft member 23 and arranged in a cylindrical unit linear motor case 27 in the axial direction. The coil unit 24 serves as a stator, and the shaft member 23 serves as an output shaft that moves the unit linear motor 15. The shaft member 23 comprises one round bar-like member but may comprise a plurality of permanent magnets arranged in the axial direction.

The unit linear motor case 27 is fixed to a general motor frame 31 so that the coil unit 24 of each unit linear motor 15 constitutes a motor stator for the linear motor 12. The coils 25 of the coil units 24 of the individual unit linear motors 15 may be installed in one common general motor frame 31 without providing the individual unit linear motor cases 27.

One ends of the shaft member 23 of the unit linear motors 15 are coupled together by an upper output shaft coupling frame 32, and other ends of the shaft member 23 of the unit linear motors 15 are coupled together by a lower output shaft coupling frame 33. An output shaft 34 (FIGS. 2, 4) of the linear motor 12 is provided in the center of the lower output shaft coupling frame 33.

In FIG. 2, the first linear motor 11 comprises a unit linear motor assembly of a plurality of unit linear motors arranged on a circumference around the predetermined axis (see FIG. 6) similarly to the second linear motor 12. The number of unit linear motors 15 in the first linear motor 11 is set equal to or greater than that in the second linear motor 12 and is six in the illustrated example. The configuration of the unit linear motor 15 of the first linear motor 11 is the same as that of the unit linear motor 15 of the second linear motor 12, described above with reference to FIG. 5, except that the former has higher power and a larger external size than the latter. Thus, corresponding components are denoted by the same reference numerals and their description is omitted. The unit linear motors 15 of the first linear motor 11 and the second linear motor 12 may be specified to have the same size and power.

The unit linear motor cases 27 are fixed together by a general motor frame 26 so that the coil units 24 of the unit linear motors 15 of the each first linear motor 11 constitute a motor stator for the first linear motor 11. One ends of the shaft member 23 of the each unit linear motors 15 of the first linear motor 11 are coupled together by a front output shaft coupling frame 28, and other ends of the shaft member 23 of the each unit linear motors 15 of the first linear motor 11 are coupled together by a rear output shaft coupling frame 29. The output shaft 30 of the second linear motor 12 is provided at a center of the front output shaft coupling frame 28.

An input side end of the input lever 17 of the boosting mechanism 10 is pivotably coupled to the output shaft 30 of the first linear motor 11.

The output portion shaft 20 of the boosting mechanism 10 is supported by the press frame 1 or the general motor frame 31 of the second linear motor 12 so as to be able only to elevate and lower via guide means such as a bush or a direct-acting rolling bearing (not shown in the drawings). On the other hand, as shown in FIG. 2 and FIG. 4, an upward extending coupled shaft 37 is provided on the output shaft 34 of the linear motor 12 and is slidably fitted in a hollow shaft portion of the output portion shaft 20 of the boosting mechanism 10.

Figure 4:
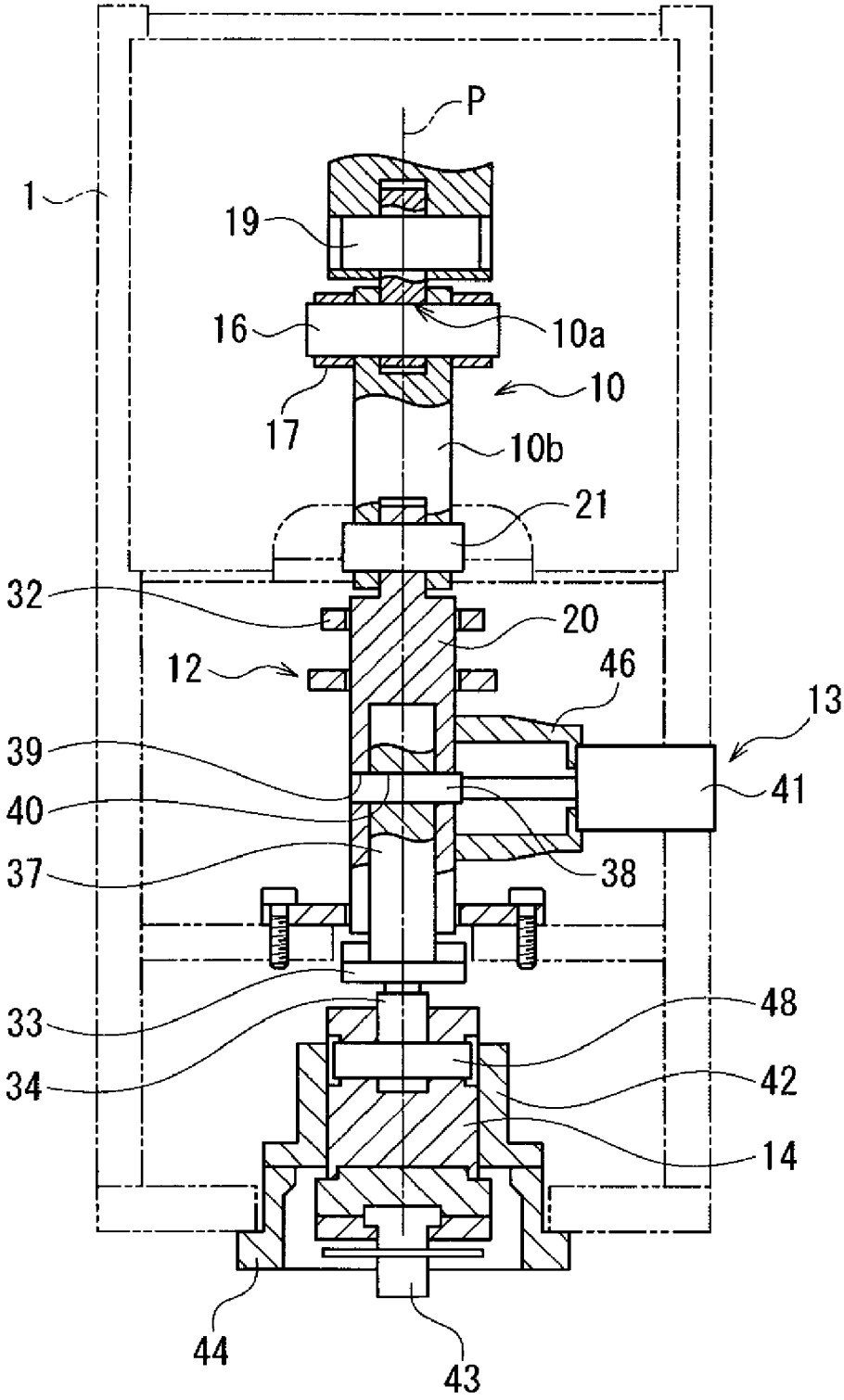
FIG. 4 is an exploded front view showing the relationship between the boosting mechanism, the second linear motor and a coupling switching mechanism which are provided in the linear motor mounted press machine.

As shown in FIG. 4, combining holes 39, 40 are formed in fitting portions of the output portion shaft 20 and the coupled shaft 37 so that a combining shaft 38 can be fitted both into the output portion shaft 20 and into the coupled shaft 37. The combining shaft 38 is inserted into and removed from a combining hole 40 in the coupled shaft 37 of the linear motor 12 side by an insertion and removal driving source 41 installed on the output portion shaft 20 via a mounting member 46. The insertion and removal driving source 41, the combining shaft 38, the combining holes 39, 40, and the coupled shaft 37 constitute the coupling switching mechanism 13. The insertion and removal driving source 41 comprises an electromagnetic solenoid, a cylinder device, or the like.

As shown in FIG. 2, the output shaft 34 of the second linear motor 12 is swingably coupled to the ram 14 by a pin 48. The ram 14 is fitted in a ram guide 42 installed in the press frame 1 so as to be able to elevate and lower. A striker 43 is provided under the ram 14 so as to be movable in a direction orthogonal to the press working axis center P. A shift driving source 44 can vary the position of the striker 43 relative to the center of the ram 14. The striker 43 drivingly pushes up the punch press tool 6.

Where the press tool 6 has a plurality of individual tools 6*a* as shown in FIG. 2, the striker 43 allows the individual tools 6*a* to be selectively driven. Where the press tool 6 has no individual tools 6*a*, the striker 43 is not provided and the ram 14 directly drives the press tool 6.

With reference to FIG. 1, a control system will be described. A control device 50 controls the whole linear motor mounted press machine and comprises a computerized numerical control device and a programmable controller. The control device 50 executes a machining program (not shown in the drawings) via an arithmetic control section (not shown in the drawings) to control the linear motor mounted press machine. The control device 50 outputs control instructions to an index driving source (not shown in the drawings) for the tool supports 2, 3, a feed driving source for the shafts of the work feeding device 4, the first linear motor 11 and the second linear motor 12 of the press driving mechanism 5, the coupling switching mechanism 13, and the like. The control device 50 has a coupling state and motor-to-be-used selection control means 51 and a unit linear motor selection control means 52.

When a required press tonnage is smaller than a set press tonnage, the coupling state and motor-to-be-used selection control means 51 controllably brings the coupling switching mechanism 13 into a decoupling state to allow only the second linear motor 12 to be driven. When the required press tonnage is at least the press tonnage, the coupling state and motor-to-be-used selection control means 51 controllably brings the coupling switching mechanism 13 into a coupling state to allow both the first linear motor 11 and the second linear motor 12 to be driven. In this case, for example, the first linear motor 11 is driven in synchronism with the second linear motor 12. The coupling state and motor-to-be-used selection control means 51 recognizes the required press tonnage on the basis of, for example, a value described in the machining program or obtains it by performing a predetermined arithmetic operation on a press tool to be used which is specified by the processing program.

The unit linear motor selection control means 52 controllably and selectively drives some of the plurality of unit linear motors 15 of one of the first linear motor 11 and the second linear motor 12. More specifically, the unit linear motor selection control means 52 controllably drives, for example, only three or two of the unit linear motors 15 of the first linear motor 11 which are arranged at equally distributed positions.

The operation of the above configuration will be described. For machining with a greater press tonnage, the coupling switching mechanism 13 is brought into a coupling state in which the combining shaft 38 is fitted into both combining holes 39, 40 to drive both the first linear motor 11 and the second linear motor 12. Thus, a high thrust produced by driving both the first linear motor 11 and the second linear motor 12 can be used to elevate and lower the ram 14 for the press working. The press working may be performed by driving only the first linear motor 11 without applying any driving current to the second linear motor 12. Driving of the first linear motor 11 is boosted via the boosting mechanism 10. This enables pressing with a greater press tonnage to be achieved even with the limited motor power of the first linear motor 11.

For machining with a smaller press tonnage, the coupling switching mechanism 13 is brought into a decoupling state by removing the combining shaft 38 from the combining hole 40 to allow only the second linear motor 12 to be driven. This allows the press working to be performed only by the second linear motor 12, which provides lower power, and allows the ram 14 to elevate and lower at a high speed for pressing. In this case, the output shaft 34 of the second linear motor 12 is disconnected from the boosting mechanism 10. Accordingly, the boosting mechanism 10 and the movable portion of the first linear motor 11 do not contribute to offering resistance or inertia to the driving of the second linear motor 12. This enables efficient machining.

Alternatively, for machining with a smaller press tonnage, it is possible to drive only some of the unit linear motors 15 of the second linear motor 12. Where the second linear motor 12 has two unit linear motors 15 as shown in the illustrated example, both unit linear motors are preferably driven. However, where the second linear motor 12 has at least four unit linear motors 15, energy consumption can be saved by selectively driving the unit linear motors 15. Also for the driving of the first linear motor 11, the press working may be preformed by driving only some of the unit linear motors 15.

The coupling state and decoupling state of the coupling switching mechanism 13 may be selectively switched for each machining operation for one workpiece W or for each lot, or during machining of each workpiece W.

The linear motor mounted press machine configured as described above uses the boosting mechanism 10 to enable the press working with a greater press tonnage. The second press driving source, which is the second linear motor 12, does not require any mechanism for converting rotations into rectilinear motion, as opposed to driving sources using rotary motors. The second press driving source can thus be coupled, via simple arrangements, to the output portion shaft 20 of the boosting mechanism 10, which performs rectilinear reciprocating operations. Further, the linear motor mounted press machine has the first linear motor 11 and the second linear motor 12, and the coupling switching mechanism 13 that releasably couples the second linear motor 12 to the output portion shaft 20 of the boosting mechanism 10, which boosts the power of the first linear motor 11. This enables the optimum thrust for the press tonnage to be generated, allowing the single linear motor mounted press machine to efficiently perform different machining operations including one requiring a greater press tonnage and one requiring a high speed and a smaller press tonnage.

Each of the first linear motor 11 and the second linear motor 12 is an assembly of the unit linear motors 15. This allows the power of the individual unit linear motors 15 to be collectively utilized to obtain high power. Further, the plurality of unit linear motors 15 of the second linear motor 12 are installed around the output portion shaft 20 of the boosting mechanism 10. This provides balanced rectilinear-propagation outputs even with the installation of the plurality of unit linear motors 15. The number of the unit linear motors 15 of the second linear motor 12 is the same as or smaller than that of the first linear motor 11. Consequently, machining only with the second linear motor 12 allows a thrust of a small press tonnage to be efficiently achieved.

When the coupling state and motor-to-be-used selection control means 51 is provided to controllably couple and drive the first linear motor 11 and the second linear motor 12 in accordance with the required press tonnage, the first linear motors 11 and the second linear motor 12 can be appropriately driven to efficiently perform a machining operation requiring a greater press tonnage and a machining operation requiring a high speed and a smaller press tonnage. Where the unit linear motor selection control means 52 is used to selectively drive some of the unit linear motors 15 of one of the first linear motor 11 and the second linear motor 12, machining can be achieved in accordance with the press tonnage in an energy efficient manner by driving only some of the unit linear motors 15.

Figure 7:
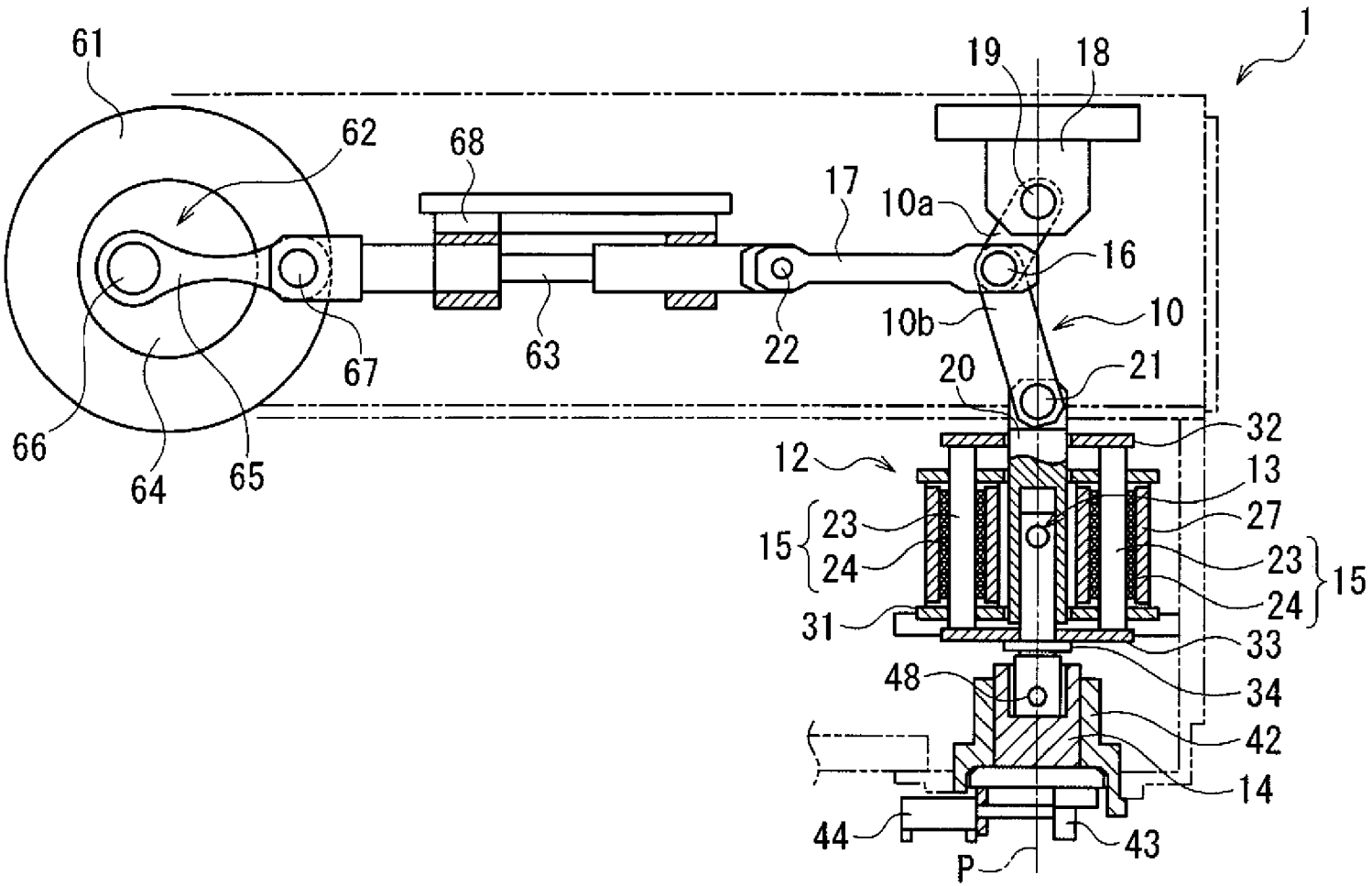
FIG. 7 is a plan view showing the relationship between a first press driving source, a boosting mechanism and a second linear motor which are provided in a linear motor mounted press machine in accordance with another embodiment of the present invention.
Figure 8:
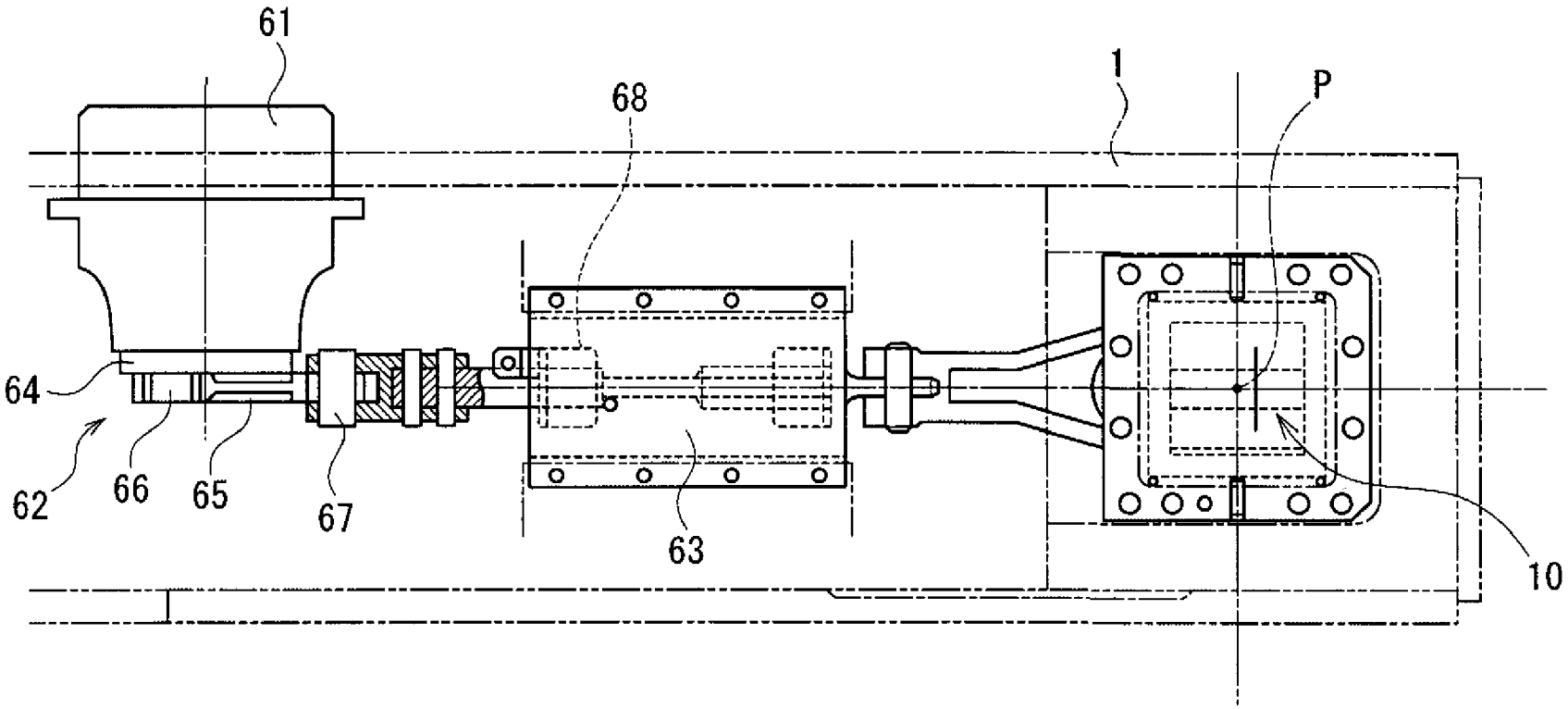
FIG. 8 is a plan view showing the relationship between the first press driving source and boosting mechanism of the linear motor mounted press machine.

FIG. 7 and FIG. 8 show another embodiment of the present invention. This embodiment corresponds to the first embodiment, described with reference to FIGS. 1 to 6, in which a servo motor 61 is installed as a first press driving source in place of the first linear motor 11. A rotating output from the servo motor 61 is converted into the rectilinear reciprocating operation of an advancing and retracting lever 63 via a crank mechanism 62. The rectilinear reciprocating operation is transmitted to the boosting mechanism 10 via the input lever 17. The advancing and retracting lever 63 is installed in the press frame 1 so as to be movable forward and backward in a horizontal direction via a guide 67. The tip of the advancing and retracting lever 63 is pivotably coupled to the input lever 17 by a pin 22. The crank mechanism 62 has a disk like crank 64 mounted around an output shaft of the servo motor 61 and a connecting rod 65 connected to an eccentric position on the crank 64 by a pin 66. The other end of the connecting rod 65 is coupled to the advancing and retracting lever 63 by a pin 67. The remaining part of the configuration of this embodiment is similar to that of the first embodiment. Thus, corresponding components are denoted by the same reference numerals and duplicate descriptions are omitted.

Thus, even when the servo motor 61 is used as a first press driving source, the boosting mechanism 10 is used to enable machining with a greater press tonnage on the basis of the rate of the power of the servo motor 61. For machining with a smaller press tonnage, only the second linear motor 12, the second press driving source, is driven to enable efficient high-speed machining. Therefore, this embodiment gives advantages similar to those of the first embodiment.

In the above description, the embodiments are applied to a punch press. However, the present invention is applicable to general press machines, for example, press brakes.

While the present invention has been described with respect to preferred embodiments thereof, it will be apparent to those skilled in the art that the disclosed invention may be modified in numerous ways and may assume many embodiments other than those specifically set out and described above. Accordingly, it is intented by the appended claims to cover all modifications of the present invention that fall within the true spirit and scope of the invention.

The invention claimed is:

1. A linear motor mounted press machine comprising: a boosting mechanism having an output portion that performs a rectilinear reciprocating operation, a first press driving source having an output shaft coupled to an input portion of the boosting mechanism, a linear motor having an output shaft serving as a second press driving source that drives a press tool forward and backward, and a coupling switching mechanism that releasably couples the output shaft of the linear motor and the output portion of the boosting mechanism together, wherein said coupling switching mechanism comprises a coupling member that is removably inserted into a hole formed in the output shaft of said linear motor and into a hole formed in the output portion of said boosting mechanism, and an insertion and removal driving source that performs operations of inserting and removing the coupling member.

2. A linear motor mounted press machine according to claim 1, characterized in that said boosting mechanism is a link mechanism.

3. A linear motor mounted press machine according to claim 1, characterized in that said first press driving source is a linear motor.

4. A linear motor mounted press machine comprising: a boosting mechanism having an output portion that performs a rectilinear reciprocating operation, a first press driving source having an output shaft coupled to an input portion of the boosting mechanism, a linear motor having an output shaft serving as a second press driving source that drives a press tool forward and backward, and a coupling switching mechanism that releasably couples the output shaft of the linear motor and the output portion of the boosting mechanism together, wherein the linear motor serves as said press driving source is a unit linear motor assembly having a plurality of unit linear motors arranged around the output portion of the boosting mechanism which performs a rectilinear reciprocating operation.

5. A linear motor mounted press machine according to claim 4, characterized in that said unit linear motor is a cylindrical linear motor having a shaft member comprising a permanent magnet having N poles and S poles alternately arranged in an axial direction and a coil unit through which the shaft member is movable relative to the coil unit.

6. A linear motor mounted press machine comprising: a boosting mechanism having an output portion that performs a rectilinear reciprocating operation, a first press driving source having an output shaft coupled to an input portion of the boosting mechanism, a linear motor having an output shaft serving as a second press driving source that drives a press tool forward and backward, a coupling switching mechanism that releasably couples the output shaft of the linear motor and the output portion of the boosting mechanism together, and a coupling state and motor-to-be-used selection controller performing control such that when a required press tonnage is smaller than a set press tonnage, said coupling switching mechanism is brought into a decoupling state to allow only the linear motor serving as the second press driving source to be driven, and where the required press tonnage is at least the set press tonnage, said coupling switching mechanism is brought into a coupling state so that the first press driving source cooperates with the second press driving source in performing a driving operation.

7. A method for controlling a linear motor mounted press machine comprising:

a boosting mechanism having an output portion that performs a rectilinear reciprocating operation;

a first press driving source having an output shaft coupled to an input portion of the boosting mechanism;

a linear motor having an output shaft serving as a second press driving source that drives a press tool forward and backward; and a coupling switching mechanism that releasably couples the output shaft of the linear motor and the output portion of the boosting mechanism together, the method being characterized by comprising:

when a required press tonnage is smaller than a set press tonnage, bringing said coupling switching mechanism into a decoupling state to allow only the linear motor serving as the second press driving source to be driven; and when the required press tonnage is at least the set press tonnage, bringing said coupling switching mechanism into a coupling state so that the first press driving source cooperates with the second press driving source in performing a driving operation.

* * * * *